United States Patent [19]

Mitchell

[11] Patent Number: 4,631,244

[45] Date of Patent: Dec. 23, 1986

[54] PROCESS FOR PREPARATION OF LIQUID TONERS FOR ELECTROSTATIC IMAGING USING POLAR ADDITIVE

[75] Inventor: Robert D. Mitchell, Wilmington, Del.

[73] Assignee: E. I. Du Pont de Nemours and Company, Wilmington, Del.

[21] Appl. No.: 830,851

[22] Filed: Feb. 18, 1986

[51] Int. Cl.[4] ..... G03G 9/12

[52] U.S. Cl. ..... 430/137; 51/323

[58] Field of Search ..... 430/137; 51/323, 325

[56] References Cited

U.S. PATENT DOCUMENTS

| | | | |
|---|---|---|---|
| 3,586,654 | 6/1971 | Lerman et al. | 430/137 |
| 3,674,736 | 7/1972 | Lerman et al. | 430/137 X |
| 3,888,054 | 6/1975 | Maselli | 51/323 X |
| 4,345,013 | 8/1982 | Diamond et al. | 430/137 X |

FOREIGN PATENT DOCUMENTS

| | | | |
|---|---|---|---|
| 58-211166 | 12/1983 | Japan | 430/137 |
| 60-104956 | 6/1985 | Japan | 430/137 |

*Primary Examiner*—Roland E. Martin

[57] ABSTRACT

Process for preparation of toner particles for electrostatic imaging comprising

A. dispersing at an elevated temperature in a vessel a thermoplastic resin, a dispersant nonpolar liquid having a Kauri-butanol value of less than 30 and optionally a colorant, the temperature being maintained to plasticize and liquify the resin and below that at which the nonpolar liquid degrades and any component decomposes;

B. cooling the dispersion, either (1) with or without stirring to form a gel or solid mass, the shredding and grinding the mass by means of particulate media in the presence of additional liquid;

(2) with stirring to form a viscous mixture and grinding by means of particulate media in the presence of additional liquid; or (3) while grinding the particulate media thereby preventing formation of a gel or solid mass in the presence of additional liquid, and C. separating the dispersion of toner particles, average by area particle size less than 10 μm, from particulate media, the improvement whereby there is present, at least during the grinding in step B, 0.5 to 99% by weight of a polar additive having a Kauri-butanol value of at least 30, the percentage based on the total weight of liquid. The dispersion having a concentration of toner particles is useful for the preparation of copies and proofs of various colors.

20 Claims, 2 Drawing Figures

PROCESS FOR PREPARATION OF LIQUID TONERS FOR ELECTROSTATIC IMAGING USING POLAR ADDITIVE

TECHNICAL FIELD

This invention relates to an improved process for the preparation of toner particles. More particularly this invention relates to a process for the preparation of toner particles in a liquid medium for electrostatic imaging wherein a polar additive is used.

BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

In one method of preparation of liquid toners for electrostatic imaging, the plasticizing of the thermoplastic polymer and colorant, if present, with a dispersant nonpolar liquid forms a gel or solid mass which is shredded into pieces, more nonpolar liquid is added, the pieces are wet-ground into particles, and grinding is continued which is believed to pull the particles apart to form fibers integrally extending therefrom. While this process is useful in preparing liquid toners, it requires long cycle times and excessive material handling, i.e., several pieces of equipment are used.

In another method of preparation of toner particles, the plasticizing and liquifying of a thermoplastic resin, a dispersant nonpolar liquid having a Kauri-butanol value of less than 30, and optionally a colorant to form a dispersion of toner particles is accomplished in a vessel in the presence of moving particulate media, the temperature being maintained to plasticize and liquify the resin but below that at which the dispersant nonpolar liquid degrades or boils and any component decomposes. The dispersion is then cooled to permit precipitation of the resin out of the dispersant, the particulate media being maintained in continuous movement during and subsequent to cooling whereby no gel or solid mass is formed and the toner particles having an average by area particle size of less than 10 μm are formed. The particulate media is then separated from the dispersion of toner particles. While this process, which requires a single piece of equipment, is useful in preparing the toner particles. particularly those having a plurality of fibers integrally extending therefrom, it requires long grinding times to attain the specified particle size.

It has been found that the above disadvantages can be overcome and toner particles prepared by a process that may not require excessive handling whereby toner particles are dispersed and toner particles are formed having an average size by area below 10 μm in the same vessel. The grinding time is reduced up to 20% over the process using a single piece of grinding equipment without a polar additive present.

BRIEF DESCRIPTION OF DRAWING

In the accompanying drawing forming a material part of this disclosure.

DISCLOSURE OF THE INVENTION

Figure 1:
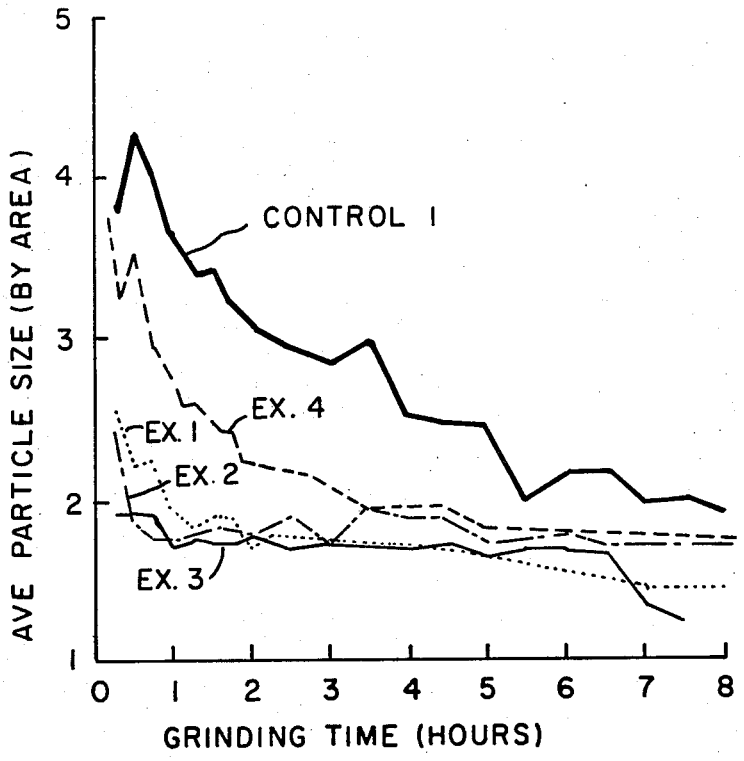
FIG. 1 is a plot of the average particle size (by area) achieved by grinding for a period of time (hours) in an attritor a dispersion of toner particles without the formation of a gel or solid mass in the presence of various polar additives as compared to grinding in an attritor without a polar additive being present.

In accordance with this invention there is provided a process for preparing toner particles for electrostatic imaging comprising A. dispersing at an elevated temperature in a vessel a thermoplastic resin, a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes;

B. cooling the dispersion, either
   (1) without stirring to form a gel or solid mass, followed by shredding the gel or solid mass and grinding by means of particulate media in the presence of additional liquid;
   (2) with stirring to form a viscous mixture and grinding by means of particulate media in the presence of additional liquid; or
   (3) while grinding by means of particulate media to prevent the formation of a gel or solid mass in the presence of additional liquid; and C. separating the dispersion of toner particles having an average by area particle size of less than 10 μm from the particulate media, the improvement whereby there is present, at least during the grinding in step B, 0.5 to 99% by weight of a polar additive having a Kauri-butanol value of at least 30, the percentage based on the total weight of liquid.

The process of this invention results in toner particles adapted for electrophoretic movement through a nonpolar liquid. The toner particles may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The toner particles are prepared from at least one thermoplastic polymer or resin, suitable colorants and dispersant nonpolar liquids as described in more detail below. In addition, a polar additive having a Kauributanol value of at least 30 is present at least during the grinding stage of the process. Preferably the polar additive is present initially in the process in an amount of 0.5 to 99% by weight of the total weight of liquid. Additional components can be added, e.g., charge director, polyethylene, fine particle size oxides such as silica, etc.

Useful thermoplastic resins or polymers which can form fibers include: ethylene vinyl acetate (EVA) copolymers (Elvax® resins, E. I. du Pont de Nemours and Company, Wilmington, Del.), copolymers of ethylene and an $\alpha,\beta$-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, isotactic polypropylene (crystalline), ethylene ethyl acrylate series sold under the trademark Bakelite® DPD 6169, DPDA 6182 Natural and DTDA 9169 Natural by Union Carbide Corp., Stamford, Conn.; ethylene vinyl acetate resins, e.g., DQDA 6479 Natural and DQDA 6832 Natural 7 also sold by Union Carbide Corp.; Surlyn® ionomer resin by E. I. du Pont de Nemours and Company, Wilmington, Del., etc. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

In addition, the resins have the following characteristics:

1. Be able to disperse the colorant, e.g., pigment,
2. Be insoluble in the dispersant liquid including polar liquid at temperatures below 40° C., so that it will not dissolve or solvate in storage,
3. Be able to solvate at temperatures above 50° C.,
4. Be able to be ground to form particles between 0.1 μm and 5 μm, in diameter,
5. Be able to form a particle (average by area) of less than 10 μm, e.g., determined by Horiba CAPA-500 centrifugal automatic particle analyzer, manufactured by Horiba Instruments, Inc., Irvine, Calif. using a centrifugal rotation of 1,000 rpm, a particle size range of 0.01 to less than 10 μm, and a particle size cut of 1.0 μm.
6. Be able to fuse at temperatures in excess of 70° C.

By solvation in 3. above, the resins forming the toner particles will become swollen or gelatinous.

Colorants, such as pigments or dyes and combinations thereof, are normally present to render the latent image visible, though this need not be done in some applications. The colorant, e.g., a pigment, may be present in the amount of up to 60 percent by weight based on the weight of the resin. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black pigment C.I. No. 77266) and Stirling NS N 774 (Pigment Black 7, C.I. No. 77266).

If desired, a finely ground ferromagnetic material may be used as a pigment. Other suitable materials such as metals including iron, cobalt, nickel, various metal oxides including: aluminum oxide, ferric oxide, cupric oxide, nickel oxide, zinc oxide, zirconium oxide, titanium oxide, and magnesium oxide; certain ferrites such as zinc, cadmium, barium, manganese; chromium dioxide; various of the permalloys and other metal alloys or metal compositions comprising, e.g., cobalt-phosphorus, cobalt-nickel, aluminum, cobalt, copper, iron, lead, magnesium, nickel, tin, zinc, gold, silver, antimony, beryllium, bismuth, cadmium, calcium, manganese, titanium, vanadium, and/or zirconium; refractory metal nitrides, e.g., chromium nitride; metal carbides, e.g., tungsten carbide, silica carbide; and mixtures of any of these may be used. Fine particle size oxides, e.g., silica, alumina, titania, etc.; preferably in the order of 0.5 μm or less can be dispersed into the liquified resin. These oxides can be used alone or in combination with the colorants.

The dispersant nonpolar liquids are, preferably, branched-chain aliphatic hydrocarbons and more particularly, Isopar®-G, Isopar®-H, Isopar®-K, Isopar®-L, and Isopar®-M. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |

-continued

| Liquid | Flash Point (°C.) | Auto-Ignition Temp (°C.) |
|---|---|---|
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature.

Into a suitable mixing or blending vessel, e.g., attritor, heated ball mill, heated vibratory mill such as a Sweco Mill Mfg. by Sweco Co., Los Angeles, Calif., equipped with particulate media for dispersing and grinding, Ross double planetary mixer manufactured by Charles Ross and Son, Hauppauge, N.Y., etc., are placed the above-described ingredients. Generally the resin, dispersant nonpolar liquid and optional colorant are placed in the vessel prior to starting the dispersing step although after homogenizing the resin and the dispersant nonpolar liquid the colorant can be added. Polar additive can also be present in the vessel, e.g., 1 to 99% based on the weight of polar additive and dispersant nonpolar liquid. The dispersing step is generally accomplished at elevated temperature, i.e., the temperature of ingredients in the vessel being sufficient to plasticize and liquify the resin but being below that at which the dispersant nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the class consisting of stainless steel, alumina, ceramic, zirconium, silica, and sillimanite. A typical diameter range for the particulate media is in the range of 0.04 to 0.5 inch (1.0 to ~13 mm).

Suitable polar liquids which have a Kauri-butanol value of at least 30 include: aromatic hydrocarbons of at least 6 carbon atoms, e.g., benzene, toluene, naphthalene, other substituted benzene and naphthalene compounds; monohydric, dihydric and trihydric alcohols of 1 to 12 carbon atoms and more, e.g., methanol, ethanol, butanol, propanol, dodecanol, etc., ethylene and other glycols, Cellosolve; etc.

After dispersing the ingredients in the vessel with or without a polar additive present until the desired dispersion is achieved, typically 1 hour with the mixture being fluid, the dispersion is cooled, e.g., in the range of 0° C. to 50° C. Cooling may be accomplished, for example, in the same vessel, such as the attritor, while simultaneously grinding in the presence of additional liquid with particulate media to prevent the formation of a gel or solid mass; without stirring to form a gel or solid mass, followed by shredding the gel or solid mass and grinding, e.g., by means of particulate media in the presence of additional liquid; or with stirring to form a viscous mixture and grinding by means of particulate media in the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time. In a grinding time of about 2 hours or less using polar liquid, particles in the average size (by area) of 0.1 to 5 μm are achieved.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is conducted to reduce the concentration of toner particles to between 0.1 to 3 percent by weight, preferably 0.5 to 2 weight percent with respect to the dispersant nonpolar liquid.

One or more charge directors as known to those skilled in the art can be added to impart a positive or negative charge as desired. The charge director may be added at any time during the process. If a diluting dispersant nonpolar liquid is also added, the charge director can be added prior to, concurrently with, or subsequent thereto. Generally 1 to 100 mg/g toner solids of the charge director is required. Suitable positive charge directors are sodium dioctylsulfosuccinate (manufactured by American Cyanimid Co.), zirconium octoate and metal soaps such as copper oleate, etc. Suitable negative charge directors are lecithin, barium petronate, calcium petronate (Witco Chemical Corp., New York, N.Y.), alkyl succinimide (manufactured by Chevron Chemical Company of California), etc. The conductivity which has proven particularly useful is in the range of about 5 to 100 pmho/cm. A preferred mode of the invention is described in Example 3.

INDUSTRIAL APPLICABILITY

The process of this invention results in dispersed toner particles having a controlled particle size range being prepared more quickly with less material handling and equipment than certain other methods of preparation. The toner is of the liquid type and is particularly useful in copying, e.g., making office copies of black and white as well as various colors; or color proofing, e.g., a reproduction of an image using the standard colors: yellow, cyan and magenta together with black as desired. In copying and proofing the toner particles are applied to a latent electrostatic image. The toner particles may have fibers integrally extending therefrom, the fibers may interdigitate, intertwine, or interlink physically in an image developed with a developing liquid through which has been dispersed the toner particles. The result is an image having superior sharpness, line acuity, i.e., edge acuity, and a high degree of resolution. The salient feature of the developed image is that it has good compressive strength, so that it may be transferred from the surface on which it is developed to a carrier sheet without squash. Because of the intertwining of the toner particles, a thicker, denser image may be built up and good sharpness still obtained. The thickness can be controlled by varying the charge potential on the photoconductor, by varying the development time, by varying the toner-particle concentration, by varying the conductivity of the toner particles, by varying the charge characteristics of the toner particles, by varying the particle size, or by varying the surface chemistry of the particles. Any or a combination of these methods may be used. The image is capable of being transferred to a carrier sheet or receptive support such as papers of the type described in the examples below, flexible films, e.g., polyethylene terephthalate; cardboard, rubber, etc.

Other uses are envisioned for the improved toner particles, e.g., the formation of copies or images using toner particles containing finely divided ferromagnetic materials or metal powders; conductive lines using toners containing conductive materials, resistors, capacitors and other electronic components; lithographic printing plates, etc.

EXAMPLES

The following controls and examples wherein the parts and percentages are by weight illustrate but do not limit the invention. In the examples the melt indices were determined by ASTM D 1238, Procedure A, and the average particle sizes by area were monitored and determined by a Horiba CAPA-500 centrifugal particle analyzer as described above.

CONTROL 1

In a Union Process O1 Attritor, Union Process Company, Akron, Ohio was placed the following ingredients in the amounts indicated:

| Ingredient | Amount (g) |
|---|---|
| Copolymer of ethylene (89%) and methacrylic acid (11%), melt index at 190° C. is 100, Acid No. is 66 | 30.0 |
| Mogul ® L carbon black C.I. No. 77266, Cabot Corp., Carbon Black Division, Boston, MA | 8.0 |
| Isopar ® L, nonpolar liquid having Kauri-butanol value of 27, Exxon Corporation | 125.0 |

The ingredients were heated to 90° C.±10° C. and milled at a rotor speed of 230 rpm with 0.1875 inch (4.76 mm) diameter stainless steel balls for one hour. The attritor was cooled to room temperature while the milling was continued and then 125 g of Isopar ®-H dispersant nonpolar liquid having a Kauri-butanol value of 27, Exxon Corporation was added. Milling was continued and the average particle size by area was monitored and the particle size recorded for an 8 hour grinding cycle. A plot of time in hours vs. average particle size for the toner particles prepared is set out in FIG. 1. In Table 1 below, the result of grinding for 2 and 4 hours is set out. The particulate media are then removed. The dispersion of toner particles can then be diluted with additional dispersant nonpolar liquid and a charge director such as basic barium petronate can be added to form a developing liquid. For example, the above solution is diluted to 2% solids using Isopar ®-H as the diluent. To 2,000 g of the diluted solution is added 50 g of a 5.5% Isopar ®-H solution of basic barium petronate charge director to form the developing liquid. Image quality can be determined using a Savin 870 copier at standard mode: charging corona set at 6.8 KV and transfer corona set at 8.0 KV using carrier sheets such as Savin 2200 paper, Plainwell off-set enamel paper #3 glass 60 lb. test.

EXAMPLES 1 to 3

The procedure of Control 1 is repeated three times except that 125 g of toluene is used in place of 125 g of Isopar ®-L (Example 1), 50 g of n-butanol is used in place of 50 g of Isopar ®-L (Example 2) and 50 g of Cellosolve (ethylene glycol monoethyl ether) is used in place of 50 g of Isopar ®-L (Example 3) present initially in the attritor. The results achieved by grinding the respective dispersions for 8 hours in the attritor are set out in FIG. 1. In Table 1 below the result of grinding for 2 and 4 hours is set out for each of the three polar liquids. It is noted that not only is the size of the toner particles (by area) smaller initially but toner particles of excellent size (by area), less than 2 μm can be achieved within 2 hours grinding time.

EXAMPLE 4

In a Union Process 1-S Attritor, Union Process Company, Akron, Ohio was placed the following ingredients in the amounts indicated:

| Ingredient | Amount (g) |
|---|---|
| Copolymer of ethylene (89%) and methacrylic acid (11%), melt index at 190° C. is 100, Acid No. is 66 | 200.0 |
| Mogul ® L carbon black C.I. No. 77266, Cabot Corp., Carbon Black Division, Boston, MA | 67.0 |
| Aromatic ® -100, high purity aromatic solvent having Kauri-butanol value of 91, Exxon Corporation | 1000.0 |

The ingredients were heated to 90° C.±10° C. and milled at a rotor speed of 230 rpm with 0.1875 inch (4.76 mm) diameter stainless steel balls for one hour. The attritor was cooled to room temperature while the milling was continued and then 700 g of Isopar ®-H dispersant nonpolar liquid having a Kauri-butanol value of 27, Exxon Corporation was added. Milling was continued and the average particle size by area was monitored and the particle size recorded for an 8 hour grinding cycle as shown in FIG. 1. The result of the grinding for 2 and 4 hours is set out in Table 1 below. An average particle size by area of less than 2 μm is achieved in less than two hours grinding time.

EXAMPLE 5

Example 4 is repeated except that the attritor was cooled to 42° C.±5° C. with cooling water while the milling was continued and the average particle size by area was monitored. The result of the grinding for 2 and 4 hours is set out in Table 1 below.

TABLE 1

| Example | Polar Additive | Ave. Particle Size (by area) 2 hrs. | 4 hrs. |
|---|---|---|---|
| — | None | 3.10 | 2.52 |
| 1 | Toluene | 1.70 | 1.68 |
| 2 | n-butanol | 1.77 | — |
| 3 | Cellosolve | 1.78 | 1.68 |
| 4 | Aromatic ® 100 | 1.65 | 1.40 |
| 5 | Aromatic ® 100 | 1.45 | 1.25 |

CONTROL 2

PREPARATION OF SPONGE

A Ross double planetary jacketed mixer, Model LDM, Charles Ross and Son Co., Hauppauge, N.Y. was charged with 500 g resin described in Control 1 , 8.8 g Dalamar ® yellow (Pigment Yellow 74), 250 g Isopar ®-L and heated to 90°-100° C. at a mixer setting of 7. After the resin melted and a homogeneous mixture with dispersed pigment formed, 1250 g of additional Isopar ®-L was slowly added, maintaining the temperature above 90° C. When this addition was complete, the mixture was discharged to a suitable container. After cooling, a gel or solid mass formed which is cut up or coarse ground to give starting material for subsequent attritor grinding.

Figure 2:
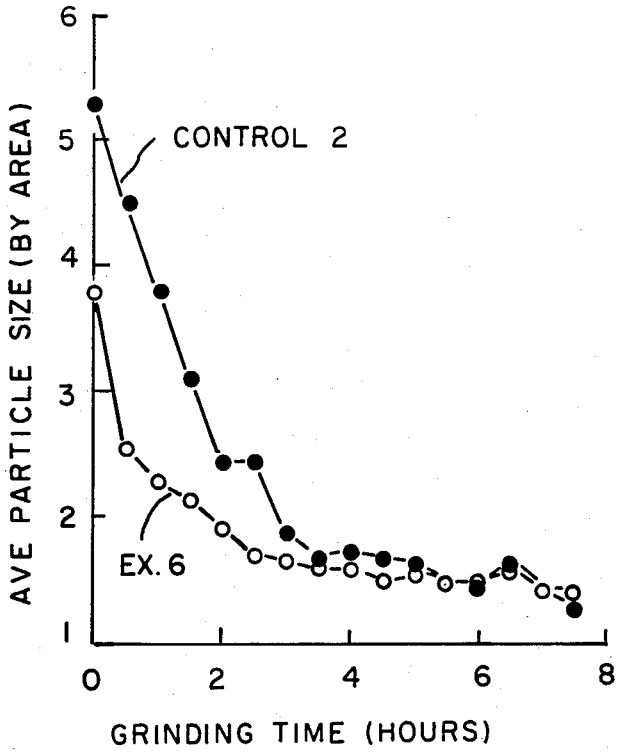
FIG. 2 is a plot of the average particle size (by area) achieved by mixing in a double planetary jacketed mixer ingredients with and without a polar additive to form a dispersion of the ingredients, discharging the dispersion into a container, cooling whereby a gel or solid mass for a period of time (hours) is formed and grinding the gel or solid mass for a period of time (hours) in an attritor.

A Union Process 01 attritor, as described in Example 1, was charged with 30 g of the gel or solid mass and 250 g of Isopar ®-H and milled for 8 hours with circulating tap water cooling the attritor. The average particle size by area was measured as described in Example 1 every 30 minutes. A plot of time vs. average particle size (by area) for the toner particles thus prepared is set out in FIG. 2.

EXAMPLE 6

A Ross double planetary jacketed mixer, described in Control 2 was charged with 500 g resin described in Control 1, 8.8 g Dalamar ® yellow (Pigment Yellow 74), 100 g ethylene glycol and heated to 90°-100° C. at a mixer setting of 7. After the resin melted and the pigment became dispersed in the resin, 1400 g of Isopar ®-L was slowly added, maintaining the temperature above 90° C. When this addition was complete, the mixture was discharged to a suitable container. After cooling, a gel or solid mass formed is cut up or coarse ground to give starting material for subsequent attritor grinding.

The milling or grinding procedure described in Control 2 was repeated. A plot of time vs. average particle size (by area) for the toner particles of this example is set out in FIG. 2. It is noted that the process of this example requires 2 hours grinding time to form toner particles of less than 4 μm size (by area).

EXAMPLE 7

A Sweco Model M18/5 Multiple-Chamber Low Amplitude Grinding Mill (Sweco, Inc., Los Angeles, Calif.) containing 0.5 inch (1.27 cm) alumina cylinders is charged with 147 g of gel or solid mass prepared as described in Control 2, 245 g Cellosolve (ethylene glycol monoethyl ether) and 155 g of Isopar ®-L. The mixture is milled at room temperature and the average particle size by area was monitored and the particle size recorded for an 8 hour period. A listing of time in hours vs. average particle size for the toner particles prepared is set out in Table 2 below.

CONTROL 3

Example 7 is repeated except that the Cellosolve polar liquid is not present and 400 g of Isopar ®-L is used. A listing of time in hours vs. average particle size for toner particles is set out in Table 2 below.

TABLE 2

| Control 3 | | Toner Example 7 | |
|---|---|---|---|
| Time (Hours) | Ave. Particle Size (μm) | Time (Hours) | Ave. Particle Size (μm) |
| 0.5 | 7.55 | 0.5 | 5.57 |
| 1.0 | 6.01 | 1.0 | 5.15 |
| 1.5 | 6.05 | 1.5 | 4.29 |
| 2.0 | 5.00 | 2.0 | 3.96 |
| 2.5 | 4.95 | 2.5 | 4.10 |
| 3.0 | 4.90 | 3.0 | 3.90 |
| 3.5 | 4.33 | 3.5 | 3.70 |
| 4.0 | 4.12 | 4.0 | 3.72 |
| 4.5 | 3.91 | 4.5 | 4.03 |
| 5.0 | 3.88 | 5.0 | 3.41 |
| 5.5 | 3.44 | 5.5 | 3.11 |
| 6.0 | 3.41 | 6.0 | 3.06 |
| 6.5 | 3.25 | 7.0 | 3.27 |
| 7.0 | 3.27 | 8.0 | 2.71 |
| 7.5 | 3.09 | | |
| 8.0 | 2.91 | | |

It is noted that the average particle size (by area) of the toner of Example 7 is 3.96 μm in 2 hours whereas a comparable average particle size (by area) of Control 3 takes over 4 hours.

I claim:

1. A process for preparing toner particles for electrostatic imaging comprising

A. dispersing at an elevated temperature in a vessel a thermoplastic resin, a dispersant nonpolar liquid having a Kauri-butanol value of less than 30, and optionally a colorant, while maintaining the temperature in the vessel at a temperature sufficient to plasticize and liquify the resin and below that at which the dispersant nonpolar liquid degrades and the resin and/or colorant decomposes;

B. cooling the dispersion, either (1) without stirring to form a gel or solid mass, followed by shredding the gel or solid mass and grinding by means of particulate media in the presence of additional liquid;

(2) with stirring to form a viscous mixture and grinding by means of particulate media in the presence of additional liquid; or (3) while grinding by means of particulate media to prevent the formation of a gel or solid mass in the presence of additional liquid; and C. separating the dispersion of toner particles having an average by area particle size of less than 10 μm from the particulate media, the improvement whereby there is present, at least during the grinding in step B, 0.5 to 99% by weight of a polar additive having a Kauri-butanol value of at least 30, the percentage based on the total weight of liquid.

2. A process according to claim 1 wherein the 0.5 to 99% of the polar liquid based on the total weight of liquid is present during step A.

3. A process according to claim 1 wherein the polar liquid is taken from the group consisting of aromatic hydrocarbons of at least 6 carbon atoms, monohydric, dihydric and trihydric alcohols of 1 to 12 carbon atoms.

4. A process according to claim 1 wherein the particulate media are taken from the class consisting of stainless steel, ceramic, alumina, zirconium, silica, and sillimanite.

5. A process according to claim 4 wherein the particulate media are spherical having an average diameter of 0.04 to 0.5 inch.

6. A process according to claim 1 wherein the thermoplastic resin is a copolymer of ethylene and an $\alpha$-$\beta$-ethylenically unsaturated acid selected from the class consisting of acrylic acid and methacrylic acid.

7. A process according to claim 1 wherein the thermoplastic resin is an ethylene vinyl acetate copolymer.

8. A process according to claim 1 wherein a colorant is present comprising carbon black.

9. A process according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

10. A process according to claim 6 wherein the thermoplastic resin is a copolymer of ethylene (89%) methacrylic acid (11%) having a melt index at 190° C. of 100.

11. A process according to claim 1 wherein a colorant is present comprising a colored material.

12. A process according to claim 1 wherein a colorant is present which is a pigment comprising finely divided ferromagnetic material.

13. A process according to claim 1 wherein a fine particle size oxide is present.

14. A process according to claim 1 wherein after step C a charge director is added to the dispersion to impart an electrostatic charge of predetermined polarity to the toner particles.

15. A process according to claim 1 wherein a plurality of thermoplastic resins are employed in the dispersing step A.

16. A process according to claim 1 wherein the additional dispersant nonpolar liquid, polar liquid or combinations thereof is present to reduce the concentration of toner particles to between 0.1 to 10 percent by weight with respect to the liquid.

17. A process according to claim 1 wherein the toner particles have an average by area particle size of less than 5 $\mu$m.

18. A process according to claim 1 wherein cooling the dispersion is accomplished while grinding by means of particulate media to prevent the formation of a gel or solid mass in the presence of additional liquid.

19. A process according to claim 1 wherein cooling the dispersion is accomplished without stirring to form a gel or solid mass, followed by shredding the gel or solid mass and grinding by means of particulate media in the presence of additional liquid.

20. A process according to claim 1 wherein cooling the dispersion is accomplished with stirring to form a viscous mixture and grinding by means of particulate media in the presence of additional liquid.

* * * * *